US007591521B2

(12) United States Patent
Aruga

(10) Patent No.: US 7,591,521 B2
(45) Date of Patent: Sep. 22, 2009

(54) IMAGE FORMING APPARATUS AND METHOD

(75) Inventor: Toshinao Aruga, Tokyo (JP)

(73) Assignee: Olympus Corporation, Tokyo (JP)

( * ) Notice: Subject to any disclaimer, the term of this patent is extended or adjusted under 35 U.S.C. 154(b) by 309 days.

(21) Appl. No.: 11/455,330

(22) Filed: Jun. 19, 2006

(65) Prior Publication Data

US 2006/0284910 A1 Dec. 21, 2006

(30) Foreign Application Priority Data

Jun. 21, 2005 (JP) ..... 2005-180857

(51) Int. Cl.
*B41J 29/38* (2006.01)
*B41J 29/393* (2006.01)

(52) U.S. Cl. ..... 347/13; 347/19

(58) Field of Classification Search ..... 347/13, 347/19

See application file for complete search history.

(56) References Cited

U.S. PATENT DOCUMENTS 6,543,872 B2 * 4/2003 Ohtsuka et al. ..... 347/19
6,655,771 B2 * 12/2003 Matsumoto et al. ..... 347/13
2002/0008731 A1 * 1/2002 Matsumoto et al. ..... 347/42
2002/0024557 A1 2/2002 Matsumoto

FOREIGN PATENT DOCUMENTS

JP 2002-144542 A 5/2002
JP 2003-320647 * 11/2003
JP 2003-320647 A 11/2003

* cited by examiner

*Primary Examiner*—Julian D Huffman
(74) *Attorney, Agent, or Firm*—Frishauf, Holtz, Goodman & Chick, P.C.

(57) ABSTRACT

This is an image forming apparatus provided with a recording head obtained by overlapping and disposing a plurality of short recording heads with a nozzle array composed of ink-jet nozzles arrayed in one direction, for jetting ink from the ink-jet nozzle, based on an image signal value and forming an image. The image forming apparatus comprises an overlap correction control unit for controlling drive of the ink-jet nozzles, according to a phase difference in a ink-jet nozzle position between the overlapped short recording heads to correct optical density of an image formed on an overlapped part of the recording heads and an optical density characteristic correction control unit for controlling drive of the ink-jet nozzles, according to a recording optical density characteristic of a nozzle array composed of the ink-jet nozzles independently of the overlap correction control unit.

11 Claims, 17 Drawing Sheets

IMAGE FORMING APPARATUS AND METHOD

CROSS REFERENCE TO RELATED APPLICATIONS

This application is based upon and claims the benefit of priority from the prior Japanese Patent Application No. 2005-180857 filed Jun. 21, 2005, the entire contents of which are incorporated herein by reference.

BACKGROUND OF THE INVENTION

1. Field of the Invention

The present invention relates to an image forming apparatus provided with a recording head with a plurality of nozzle arrays, for forming an image on an image-formed material, and more particularly, relates to an image forming apparatus provided with at least one long recording head composed of a plurality of short recording heads.

2. Description of the Related Art

For example, the recording head of the ink-jet type image forming apparatus has a tendency to multiply or lengthen a recording device (ink-jet nozzle) in order to meet the requirements of high-speed image formation (image recording).

As such an image forming apparatus, a structure provided with a so-called line head for disposing (forming) a recording device (ink-jet nozzle) across one side (width direction) of an image-formed material (recording medium) is known.

An image forming apparatus provide with a line head can form an image all over this image-formed material by relatively moving the image-formed material in the direction orthogonal to the ink-jet nozzle array direction of a line head (sub scan direction) and then jetting ink on the image-formed material from the ink-jet nozzle. Since the image forming apparatus provide with a line head needs neither the movement of a carriage nor the intermittent conveyance of the image-formed material, it can rapidly and easily form an image.

However, the line head has disadvantages that its cost is high compared with a short recording head, that its quality yield is bad, that its reliability is low and the like.

An image forming apparatus utilizing the advantages in cost of a short recording head, in its quality yield, in its reliability and the like by disposing a plurality of short recording heads in each of which a plurality of ink-jet nozzles is arrayed in one direction (main scan direction) in order to solve these problems is also known.

However, in the line head composed of such short recording heads, if there is a phase difference in pitch between nozzle arrays (improper pitch), striped optical density unevenness, white-wiping and the like are sometimes formed.

Patent reference 1 (Japanese Patent Application Publication No. 2002-144542) discloses am image recording method capable of recording a high-quality image without color/optical density unevenness or the like in an image recording apparatus in which one recording head (line head) is obtained by disposing a plurality of short (recording) heads.

The image recording method disclosed by patent reference 1 is described below with reference to FIGS. 1A~1C.

The recording head 10 shown in FIG. 1A comprises a plurality of short heads 12A and 12B. In this recording head 10, a plurality of adjacent ink-jet nozzles 11A of the short head 12A and a plurality of adjacent ink-jet nozzles 11B of the short head 12B are disposed in such a way that a part of them overlaps when viewed from the sub scan direction. This joint area (overlapped area) corresponds to ink-jet nozzles 11A-1~11A-3 on the short head side 12A and ink-jet nozzles 11B-1~11B-3 on the short head side 12B.

In image record by the recording head 10 with such a structure, for example, as shown in the area "a" of FIG. 1B, a high-optical density recording area occurs along the sub scan direction in the joint area of the ink-jet nozzles 11A-1~11A-3 of the short head 12A and the ink-jet nozzles 11B-1~11B-3 of the short head 12B, and a high-quality image cannot be recorded.

In such a case, a record control unit for controlling the recording head 10 to record an image, which is not shown in FIG. 1, determines the ink-jet nozzle 11A-2 of the short head 12A and the ink-jet nozzle 11B-2 of the short head 12B, which is shown by an one-dot chain line as one example, as a joint point and the use of the ink-jet nozzles 11A-1 and 11B-1 located further on the top end is stopped.

Since the space between the ink-jet nozzles 11A-2 and 11B-2, which are the joint point is narrower than a proper pitch, the o optical density in the joint point becomes higher than a proper value, as shown in the area "a" of FIG. 1A. In order to correct this, the record control unit stops the drive of one of the ink-jet nozzles 11 on every another line in the sub scan direction to record an image with proper optical density. In an example of an area "b" of FIG. 1B, the drive of the ink-jet nozzle 11B-2 of the short head 12B is stopped on every another line in the sub scan direction.

The image recording method of patent reference 1 can record a high-quality image without color/optical density unevenness and the like, by performing such control.

In this case, in an ink-jet recording head using a piezoelectric device (PZT), generally the amount of ink jetted from the ink-jet nozzle at the head end increases or decreases compared with that in an area other than the end, that is, a non-end area. In the case of an image recording apparatus with one recording head, even when there is a little change in optical density due to the change of the amount of ink jetted from a specific number of ink-jet nozzles on the end in such a phenomenon, a part whose optical density has changed becomes the end of an image recording area. Therefore, the optical density unevenness of a recorded image is not remarkable. However, in the case of an image recording apparatus with a line head obtained by adjacently disposing a plurality of recording heads, the joint part of adjacent recording heads becomes inner than the end of the image recording area. Therefore, when optical density unevenness occurs in this part, striped optical density unevenness, white-wiping and the like becomes remarkable in a recorded image.

Patent reference 2 (Japanese Patent Application Publication No. 2003-320647) discloses a method for visually reducing optical density unevenness due to the fluctuations of the jet amount of ink (ink jet volume) at the end of such a recording head.

The method of this patent reference 2 determines which an input image signal is, the end area signal or non-end area signal of a corresponding recording head. If it is determined that that it is the end area signal, an end area correction process is performed. If it is determined that that it is the non-end area signal, a non-end area correction process is performed.

In the end area correction process, the end area is corrected in such a way that there is almost no difference in visual optical density between the non-end and end areas. In the non-end area correction process, the non-end area is corrected in such a way that there is almost no difference in visual optical density between the non-end and end areas, and it is also corrected in such a way that a optical density value gradually decreases from the end toward the center. The method of patent reference 2 corrects the end and non-end areas and also reduces optical density unevenness.

However, although patent reference 1 discloses a method for improving the optical density unevenness of a nozzle array overlapped part between adjacent short heads, it does not disclose a method for improving unevenness due to a non-uniform recording characteristic between nozzles arrays. Therefore, only the method disclosed by patent reference 1 cannot improve unevenness due to this non-uniform recording characteristic.

Although patent reference 2 discloses a method for improving unevenness due to non-uniform ink jet volume from the ink-jet nozzles, the relative positions of short heads are adjusted and disposed in such a way that one ink-jet nozzle in the joint part of adjacent short heads can be matched with the other ink-jet nozzle in the joint part when viewed from the sub scan direction.

The recording devices (ink-jet nozzle) are formed at very fine intervals. For example, if its resolution is 300 dpi, the interval becomes 85 μm. In the method disclosed by patent reference 2, for example, a locating mechanism for locating a ink-jet nozzle of one short head and the ink-jet nozzle of the other adjacent short head at intervals of 85 μm with no error is needed, which incurs the cost-up of the apparatus.

The generation factor and degree of optical density unevenness due to the nozzle array overlapped part of this short head and those of optical density unevenness due to the non-uniform recording characteristic between ink-jet nozzles are different.

FIG. 2A shows the recording optical density characteristic of a recording head (short head) in which the ink-jet nozzle at the nozzle array end is higher than that at non-end.

FIG. 2B shows the recording optical density characteristic of a recording head (line head) in which the two short heads with the recording optical density characteristic shown in FIG. 2A are adjacently disposed in such a way that a part of their ink-jet nozzles are overlapped when viewed from the above-described sub scan direction.

Since as shown in FIG. 2A, the optical density unevenness due to the non-uniform recording characteristic between ink-jet nozzles is due to the little structural or manufacturing error in the jet amount of ink (ink jet volume) between recording heads, its optical density change value becomes small and gentle.

Since as shown in FIG. 2B, the optical density unevenness in the nozzle overlapped part of a recording head is due to a optical density change according to the phase difference in a ink-jet nozzle position between nozzle arrays of adjacent recording heads, its optical density change value becomes large and steep.

Therefore, in order to correct optical density unevenness due to these two factors, a sufficient correction effect cannot be obtained only by simply combining two methods (technologies) disclosed by patent references 1 and 2, and accordingly no high-quality image can be obtained.

SUMMARY OF THE INVENTION

It is an object of the present invention to provide an image forming apparatus capable of making striped optical density unevenness, white-wiping and the like, due to the joint part of adjacent recording heads unremarkable and also correcting optical density unevenness due to the non-uniform recording optical density characteristic between short recording heads, without disposing short recording heads according to strict position adjustment in an image forming apparatus with one long recording head obtained by disposing a plurality of short recording heads.

The present invention presumes an image forming apparatus provided with a recording head obtained by overlapping and disposing a plurality of short recording heads each with ink-jet nozzles arrayed in one direction, for and jetting ink from the ink-jet nozzles, based on an image signal value and forming an image, which comprises an overlap correction control unit and a optical density characteristic correction control unit.

The overlap correction control unit controls the drive of ink-jet nozzles, according to the phase difference in a ink-jet nozzle position between overlapped short recording heads to correct the optical density of an image formed by the overlapped part of recording heads.

The optical density characteristic correction control unit operates independently of the overlap correction control unit and controls the drive of ink-jet nozzles, according to the recording optical density characteristic of the nozzle array of the ink-jet nozzles.

The present invention also includes the image formation method of the image forming apparatus.

DESCRIPTION OF THE PREFERRED EMBODIMENTS

The preferred embodiments of the present invention are described in detail below with reference to the drawings.

Figure 3:
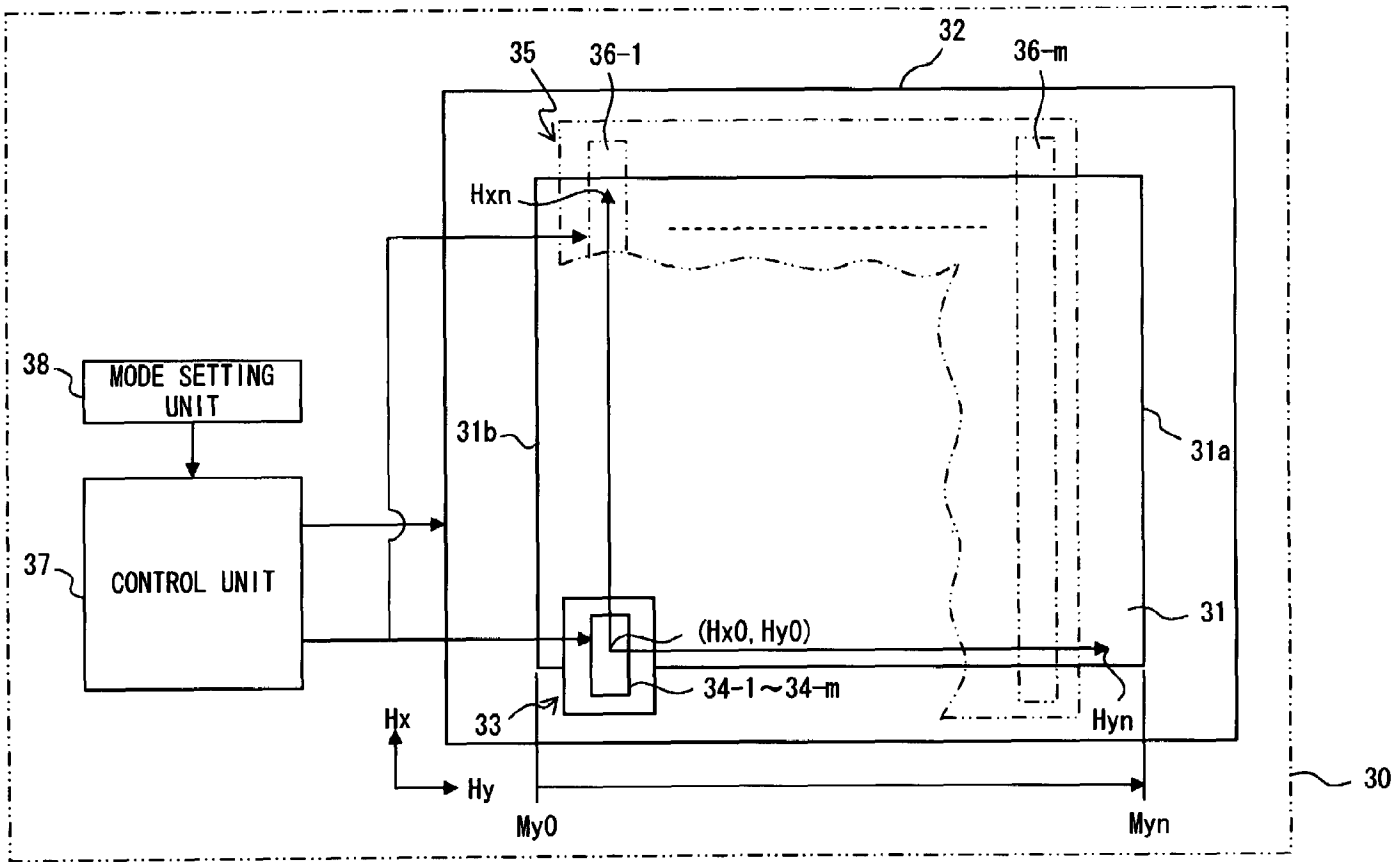
FIG. 3 shows an example of the conceptual configuration of the image forming apparatus of the preferred embodiment.

FIG. 3 shows an example of the conceptual configuration of the image forming apparatus of the preferred embodiment.

FIG. 3 show examples of both the configurations of the image forming apparatus 30 in the case where it is of a serial type and of a full line type in one drawing.

The serial type image forming apparatus 30 shown in FIG. 3 comprises a mounting table 32 provided with a moving mechanism for mounting and holding an image-formed material 31 or a moving mechanism for holding in such a way as to move the image-formed material 31 in the sub scan direction. In the upper section of the mounting table 32, at least one of recording units 34-1~34-m (m=an integer of 2 or more), each with a plurality of nozzle arrays (short recording heads) and each with a plurality of ink-jet nozzles (ink jet outlets) formed, are disposed on a moving object 33. The moving object 33 is movably supported by the moving mechanism, which is not shown in FIG. 3, and is moved in the main scan direction (Hx0~Hxn) and sub scan direction (Hy0~Hyn) or only in the main scan direction (Hx0~Hxn). In the case of this serial type image forming apparatus, an image is formed on the image-formed material 31 mounted on the mounting table 32 or held in such a way as to move in the sub scan direction while at least one of the recording units 34-1~34-m, disposed on the moving object 33 relatively, move only in the main scan direction or in both the main scan and sub scan directions.

The full line type image forming apparatus 30 shown in FIG. 3 comprises a moving mechanism for mounting the image-formed material 31 and moving and carrying it in the sub scan direction, which is not shown in FIG. 3. In the upper section of this moving mechanism, which is not shown in FIG. 3, carriages 35 in which at least one of the recording units 36-1~36-m (m=integer of two or more) each with a plurality of nozzle arrays each composed of a plurality of ink-jet nozzles are oppositely deposited. In the case of this full line type image forming apparatus, an image is formed on the image-formed material 31 while the moving mechanism, which is not shown in FIG. 3, relatively moves the image-formed material 31 held in such a way as to move in the sub scan direction against at least one of the recording units 36-1~36-m.

In the carriage 35 indicated by a two-dot chain line in FIG. 3, a plurality of ink-jet nozzles of at least one of the recording units 36-1~36-m are disposed as a plurality of nozzle arrays (short recording heads) at least across the length of over the width in the main scan direction (Hx) of the image-formed material 31.

In the case of this full line type image forming apparatus, an image is formed by moving the top end 31*a* in the sub scan direction (Hy) of the image-formed material 31 to My0~Myn by the moving mechanism, which is not shown in FIG. 3, and further jetting ink on the image-formed material 31 by at least one of the recording units 36-1~36-m while moving the back end 31*b* in the sub scan direction (Hy) of the image-formed material 31 to My0~Myn in FIG. 3.

As described above, in each image forming apparatus with a different configuration, the serial type image forming apparatus adjusts an image formation point (ink jet point) on the image-formed material 31 by changing jet timing for each of a plurality of nozzle arrays in at least one of the recording units 34-1~34-m while a control unit 37 controls to move the moving object 33 with at least one of the recording units 34-1~34-m in the main scan direction.

The full line type image forming apparatus adjusts an image formation point (ink jet point) on the image-formed material 31 by changing jet timing for each of a plurality of nozzle arrays in at least one of the recording units 36-1~36-m while a control unit 37 controls to move the image-formed material 31 in the sub scan direction by the moving mechanism, which is not shown in FIG. 3.

In the image forming apparatus 30 of the preferred embodiment, the control unit 37 comprises a optical density characteristic correction control unit and an overlap correction control unit, which are described later. When forming an image, the image forming apparatus 30 corrects an input image signal 41, using an optical density characteristic correction control unit 46 and an overlap correction control unit 47, based on an image formation mode set from a mode setting unit 38 by an operator or a correction value recorded in the control unit 37 as an already known value.

Figure 4:
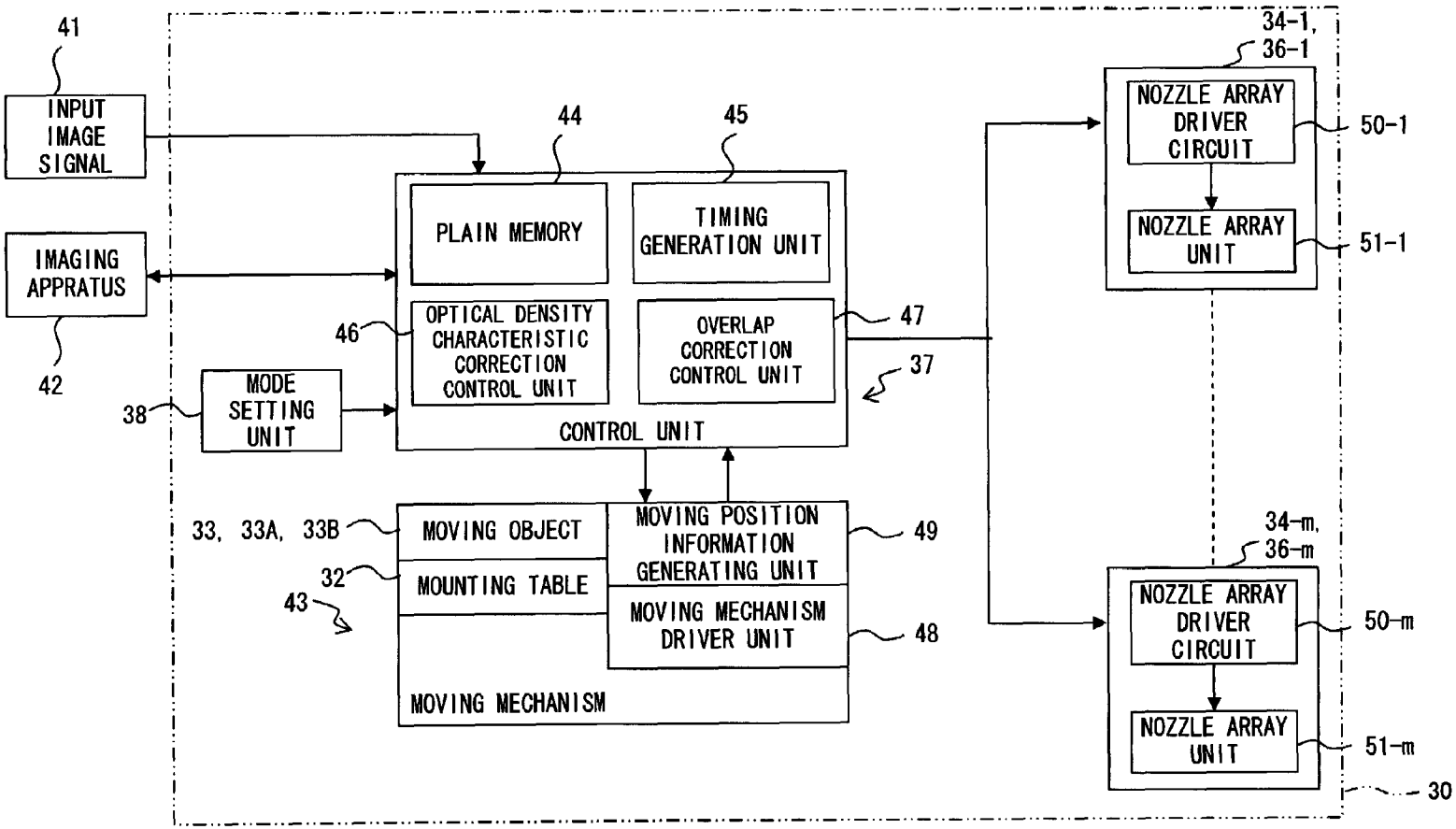
FIG. 4 shows an example of the configuration of the image forming apparatus of the preferred embodiment.

FIG. 4 shows an example of the configuration of the image forming apparatus of the preferred embodiment.

The image forming apparatus of the preferred embodiment shown in FIG. 4 comprises a moving mechanism 43 including the above-described the mounting table 32 for supporting the moving object 33 in such a way as to move in a prescribed direction in addition to the moving object 33, at least one the recording units 34-1~34-m, at least one the recording units 36-1~36-m, the control unit 37 and the mode setting unit 38, which are shown in FIG. 3.

The at least one of the recording units 34-1~34-m or 36-1~36-m comprise at least one of the nozzle array driver circuits 50-1~50-m (m=integer of two or more) and a nozzle array units 51-1~51-m (m=integer of two or more). Then, at least one of the nozzle array units 51-1~51-m comprises a plurality of nozzle arrays (short recording heads). The control unit 37 comprises a plain memory 44, a timing generation unit 45, the optical density characteristic correction control unit 46, and the overlap correction control unit 47. The moving mechanism 43 comprises a moving mechanism driver unit 48 and a moving position information generating unit 49. In the case of the serial type image forming apparatus, the moving mechanism further comprises the mounting table 32.

The control unit 37 is composed of a CPU and like, and supervises and controls this entire image forming apparatus 30. The control unit 37 controls the moving mechanism driver unit 48 of the moving mechanism 43, processes a signal indicating the location of the moving object 33 notified by the moving position information generating unit 49, instructs to control the timing generation unit 45, stores an externally inputted the input image signal 41 in the plain memory 44 and so on. The control unit 37 also corrects the input image signal 41 by the optical density characteristic correction control unit 46 and the overlap correction control unit 47. The optical density characteristic correction control unit 46 controls the drive of each ink-jet nozzle to determine the jet amount of ink, according to the recording optical density characteristic of nozzle arrays (short recording heads) constituting the nozzle array units 51-1~51-m. The overlap correction control unit 47 controls the drive of each ink-jet nozzle to determine the jet amount of ink, according to the phase difference in a ink-jet nozzle position between nozzle arrays (short recording heads). This detailed correction process is described later.

The moving mechanism driver unit 48 of the moving mechanism 43 is composed of a motor and the like. The moving mechanism driver unit 48 moves the moving object 33 only in the main scan direction, only in the sub scan direction or both in the main and sub scan directions to a prescribed position, based on the control/instruction of the control unit 37. The moving position information generating unit 49 is composed of a rotary encoder and the like. The moving position information generating unit 49 notifies the control unit 37 of the amount of movement of the moving object 33 and its location as signals. The moving position information generating unit 49 can also comprise a high frequency generation circuit for multiplying by an integer the frequency of a pulse signal generated by the rotary encoder as requested.

The mode setting unit 38 is provided as a part of an input operation panel for the entire image forming apparatus 30. Alternatively, it is provided as an individual input operation panel. By operating and instructing the mode setting unit 38, the operator sets image formation modes, such as the correction function stoppage of the optical density characteristic correction control unit 46, the correction function stoppage of the overlap correction control unit 47 and the like, in the image forming apparatus 30. When a correction mode selected by the type of the image-formed material 31 or the like, the optical density characteristic correction control unit 46 and the overlap correction control unit 47, which are described later, correct the input image signal 41, based on this correction mode.

An imaging apparatus 42 shown in FIG. 4 is an external apparatus provided with a function to detect the optical density of an image formed on the image-formed material 31, such as a scanner connected to the image forming apparatus 30 or the like. The imaging apparatus 42, for example based on the instruction from the control unit 37, detects the optical density of the image formed on the image-formed material set in the imaging apparatus 42 and notifies the control unit 37 of the optical density.

Although in the preferred embodiment shown in FIG. 4, the image forming apparatus 30 and the imaging apparatus 42 are separated, the present invention is not limited to this configuration. The imaging apparatus 42 can also be provided inside the image forming apparatus 30 and adjustment information about image optical density unevenness and the like can also be calculated based on the detection result of the imaging apparatus 42.

The optical density characteristic correction control unit 46 controls the drive of each ink-jet nozzle, based on a detection value notified by the imaging apparatus 42, which is the external apparatus of the image forming apparatus 30, according to a nozzle array optical density characteristic of each nozzle array (short recording head) to correct image optical density unevenness. The overlap correction control unit 47 controls the drive of each ink-jet nozzle, based on a detection value notified by the imaging apparatus 42, according to the phase difference in the overlapped part of nozzle arrays (short recording heads) (relative position between the ink-jet nozzle in one nozzle array and the ink-jet nozzle in the other nozzle array) to correct image optical density unevenness.

These optical density characteristic correction control unit 46 and the overlap correction control unit 47 can be realized by dedicated hardware. Alternatively, they can be realized by a software method of executing a program by the CPU of the control unit 37. If they are configured by hardware, it is preferable to configure each of them by different hardware in order to prevent the reciprocal influences of their correction processes.

The timing generation unit 45 determines each jet timing of each nozzle array (short recording head) of at least one of the nozzle array units 51-1~51-m, based on a position adjustment parameter predetermined according to the position information in the sub scan direction of each nozzle array to control/instruct the jet position adjustment of at least one of the recording units 34-1~34-m or 36-1~36-m. The recording units 34-1~34-m or 36-1~36-m forms an image for one line according to the input image signal 41 notified by the control unit 37 by forming an image by each nozzle array (short recording head) of the at least one of the nozzle array units 51-1~51-m in this jet timing.

Next, an example of the nozzle array unit array in the case of the full line type image forming apparatus of the preferred embodiment is described.

Figure 5:
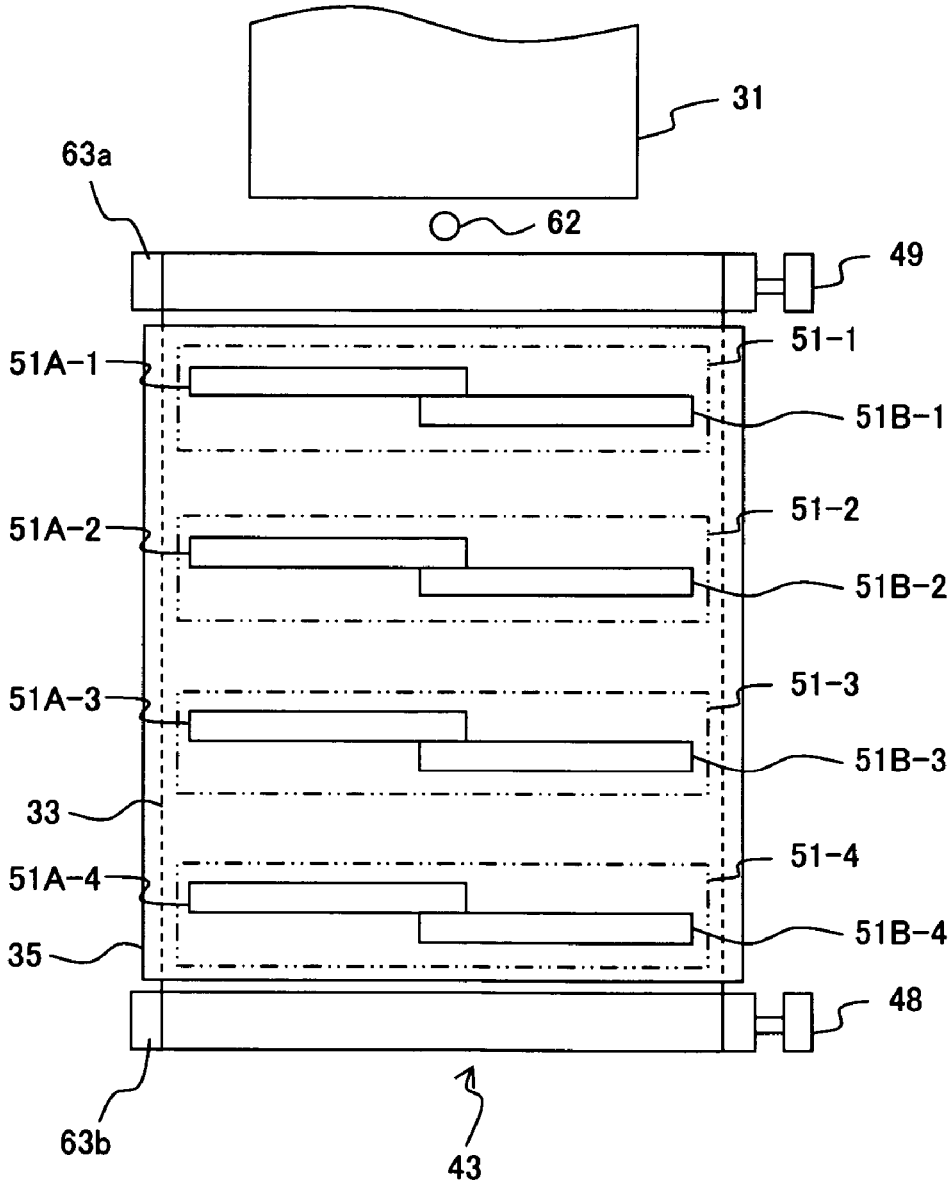
FIG. 5 shows an example of the configuration in the case where the image forming apparatus of the preferred embodiment is of a full line type, and an example of the array of a nozzle array unit.

As shown in FIG. 5, in the carriage 35 fixed and deposited opposed to the moving mechanism 43, the nozzle array units 51-1~51-m in which each color is made by jointing two short recording heads (in FIG. 5, m=4; four nozzle array units 51 of black (K) the nozzle array unit 51-1, cyan (C) the nozzle array unit 51-2, magenta (M) the nozzle array unit 51-3 and yellow (Y) the nozzle array unit 51-4) are disposed in the sub scan direction from the upper stream conveyance direction of the image-formed material 31 at prescribed intervals. In the nozzle array units 51-1~51-m, a plurality of short recording heads 51A-1, 51B-1~51A-m, 51B-m (in FIG. 5, m=4; (K) short recording heads 51A-1 and 51B-1, (C) short recording heads 51A-2 and 51B-2, (M) short recording heads 51A-3 and 51B-3 and (Y) short recording heads 51A-4 and 51B-4) are disposed corresponding to the nozzle array units 51-1~51-m. Each pair of short recording heads 51A-1 and 51B-1~51A-4 and 51B-4 comprises one to a plurality of nozzle arrays for each short recording head.

For example, a plurality of ink drops with the same volume is jetted from each ink jet outlet of the nozzle array units 51-1~51-4. Thus, the control unit 37 controls the number of ink drops jetted from the nozzle array units 51-1~51-4 by the nozzle array driver circuits 50-1~50-4 to adjust optical density gradation, that is, by a multi-drop method.

For example, if each jet outlet of the nozzle array units 51-1~51-4 can jet seven ink drops at the maximum, zero to seven ink drops including the case where no ink is jetted are jetted on the image-formed material 31 and a dot corresponding to each number of ink drops is formed. Thus, the control unit 37 can control optical density gradation of eight grades including zero grade.

Each of the color the nozzle array units 51-1~51-4 comprises a prescribed number of fluid jet outlets (ink-jet nozzles) across over the width in the main scan direction of the carried image-formed material 31. For example, in (K) the nozzle array unit 51-1 made by jointing two short recording heads, a plurality of ink-jet nozzles at the end of the short recording head 51A-1 and a plurality of ink-jet nozzles at the end of the short recording head 51B-1 are jointed in such a way as to overlap when viewed from the sub scan direction (the nozzle array units 51-2~51-4 also have the same structure as (K) the nozzle array unit 51-1).

As described above, if both ends of each nozzle array of each pair of short recording heads 51A and 51B are overlapped and disposed, the control unit 37 can selectively the input image signal 41 to each short recording head disposed in the carriage 35 to form an image. Therefore, the strict position adjustment in the nozzle array direction (main scan direction)

of each short recording head can be omitted, thereby realizing an inexpensive position adjustment mechanism.

As a position adjustment mechanism for each of the nozzle array units 51-1~51-4, for example, a mechanical adjustment mechanism for finely rotating the nozzle array units 51-1~51-4 can also be provided.

Next, an example of the configuration of the full line image forming apparatus 30 of the preferred embodiment is described.

As shown in FIG. 5, the moving mechanism 43 disposed opposed to the carriage 35 is disposed in the lower stream than an edge sensor 62 for detecting at least one end of the image-formed material 31 in the conveyance route of the image-formed material 31.

An endless belt for forming a plurality of holes in the moving object 33 shown in FIG. 3 is installed one roller 63*a* and the other roller 63*b* to rotate the other roller 63*b* by connecting it to the motor of the moving mechanism driver unit 48 and connect the rotary encoder of the moving position information generating unit 49 to the one roller 63*a*. In the lower section of this endless belt, for example, an absorbing fan, which is not shown in FIG. 5, to absorb the image-formed material 31.

The control unit 37 shown in FIG. 3 places the image-formed material 31 carried from the upper stream of the moving mechanism 43 on the endless belt of the moving mechanism 43 and absorbs it. Then, the control unit 37 forms an image while moving the lower section of the short recording heads 51A-1, 51B-1~51A-4, 51B-4 corresponding to color the nozzle array units 51-1~51-4 disposed in the carriage 35.

The control unit 37 converts the distance between the edge sensor 62 and the nozzle array of the short recording head 51A-1 corresponding to the color the nozzle array units 51-1~51-4, between the edge sensor 62, the distance between the edge sensor 62 and the nozzle of the short recording head 51B-1, the distance between the edge sensor 62 and the nozzle array of the short recording head 51A-2, the distance between the edge sensor 62 and the nozzle array of the short recording head 51B-2, the distance between the edge sensor 62 and the nozzle array of the short recording head 51A-3, the distance between the edge sensor 62 and the nozzle array of the short recording head 51B-3, the distance between the edge sensor 62 and the nozzle array of the short recording head 51A-4 and the distance between the edge sensor 62 and the nozzle array of the short recording head 51B-4 into the accumulated number of pulses of the rotary encoder and stores it in the non-volatile memory of the control unit 37 in advance.

Thus, the control unit 37 starts counting the pulse signals of the rotary encoder in the moving position information generating unit 49, using the signal which the edge sensor has detected, for example, the top end of the image-formed material 31 carried on the conveyance route as trigger information. Then, the control unit 37 forms an image in each ink jet timing the counted number of the pulse signals of this rotary encoder and the accumulated number of pulses of the rotary encoder, based on the input image signal 41, stored in advance in accordance with the nozzle array position of each of the short recording heads 51A-1, 51B-1~51A-4, 51B-4 coincide with each other.

Next, the control method of the control unit of the image forming apparatus of the preferred embodiment is described in detail.

The input image signal 41 inputted from outside the image forming apparatus 30 is stored in the plain memory 44 as a 1~n-lines of image signal (n=integer of two or more) under the control of the control unit 37. In the case of the full line type image forming apparatus 30 of the preferred embodiment, this 1~n lines of image signal corresponds to one line in the width direction of the recording area of the image-formed material 31.

If the image forming apparatus 30 of the preferred embodiment comprises, for example, the color the nozzle array units 51-1~51-4, the plain memory 44 shown in FIG. 5, divides the 1~n lines of image signal in relation with each nozzle array of the short recording heads 51A-1, 51B-1~51A-4, 51B-4 and stores them.

The control unit 37 reads the 1~n lines of the input image signal 41 stored in the plain memory 44 in synchronization with the count value of the moving position information generating unit 49, generated by carrying the image-formed material 31 after for example, the edge sensor 62 has detected its top end, and inputs it to the optical density characteristic correction control unit 46.

The optical density characteristic correction control unit 46 calculates a optical density correction signal by a process, which is described later, based on a optical density correction co-efficient set in advance according to the recording optical density characteristic of each ink-jet nozzle and the image signal value of each pixel formed on the image-formed material 31 by each ink-jet nozzle in the non-overlap part in which the ink-jet nozzles of the short recording heads do not overlap and which is jointed when viewed from the sub scan direction.

This optical density correction signal is a signal level quantization optical density correcting signal which can be inputted to each short recording head, and in each ink-jet nozzle of the nozzle array units 51-1~51-4 of the preferred embodiment, it converts its optical density into eight gradation values of zero to seven grades.

It is preferable to diffuse a quantizing error caused by quantization conversion among peripheral pixels by an error diffusion method or the like.

If the image forming apparatus 30 of the preferred embodiment comprises, for example, the color the nozzle array units 51-1~51-4 shown in FIG. 5, the image signal of each of 1~n lines converted into a quantization optical density correction signal by the optical density characteristic correction control unit 46 is divided into image signals for each nozzle array and is inputted to the overlap correction control unit 47.

Next, nozzle array overlap correction is described with reference to FIGS. 6, 7 and 8.

In the description of this nozzle array overlap correction, it is assumed that there is a phase difference between the ink-jet nozzle of one nozzle array in the overlapped part and the ink-jet nozzle on the other nozzle array when the one nozzle array and the other nozzle array are overlapped and adjacently disposed.

Figure 6B:
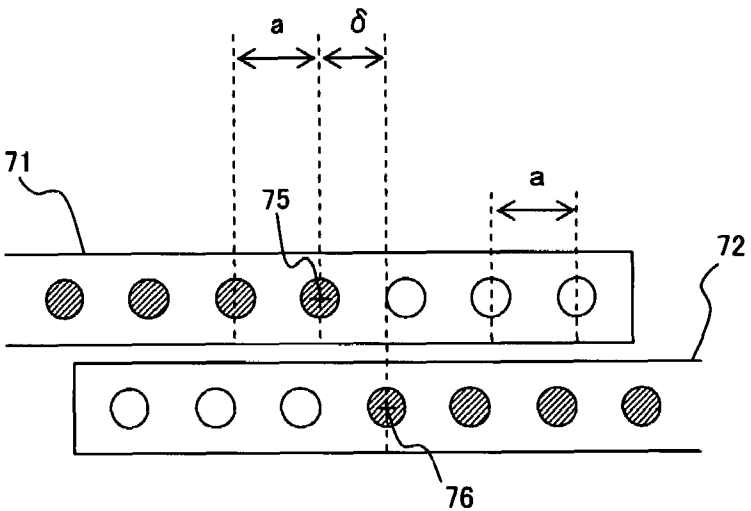
FIGS. 6A and 6B explain the phase difference in a ink-jet nozzle position between nozzle arrays of recording heads.
Figure 6A:
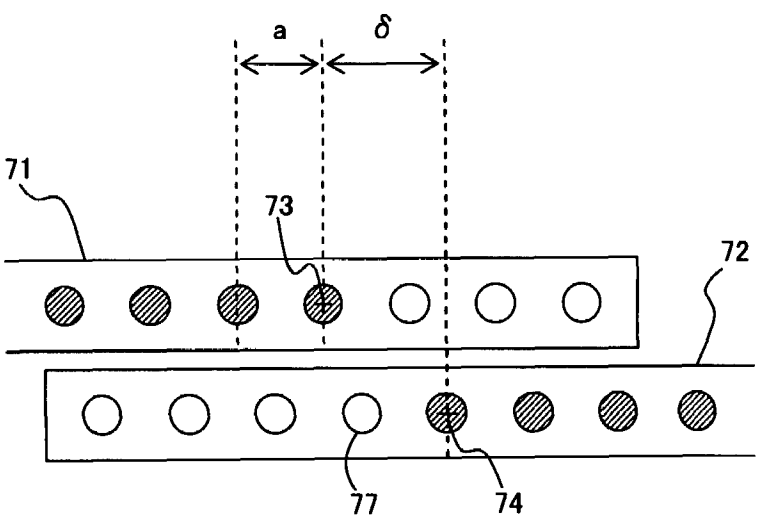

For example, when resolution is 300 dpi, the distance "a" between ink-jet nozzles of a recording head shown in FIG. 6 is approximately 85 μm. The distance δ shown in FIG. 6 indicates the phase difference in the main scan direction between the ink-jet nozzle of a recording head 71 and the ink-jet nozzle of a recording head 72. In FIG. 6A, this distance δ in a phase difference is the distance between the ink-jet nozzle 73 of the recording head 71 and the ink-jet nozzle 74 of the recording head 72. In FIG. 6B, this distance δ in a phase difference is the distance between the ink-jet nozzle 75 of the recording head 71 and the ink-jet nozzle 76 of the recording head 72.

An image signal is divided and inputted to the slashed ink-jet nozzles of the recording heads 71 and 72 shown in FIGS. 6A and 6B, and an image is formed by output dots formed by ink that is jetted from each ink-jet nozzle of the recording heads 71 and 72 (dot image).

No ink is jetted from each ink-jet nozzle not slashed in FIG. 6.

Figure 7B:
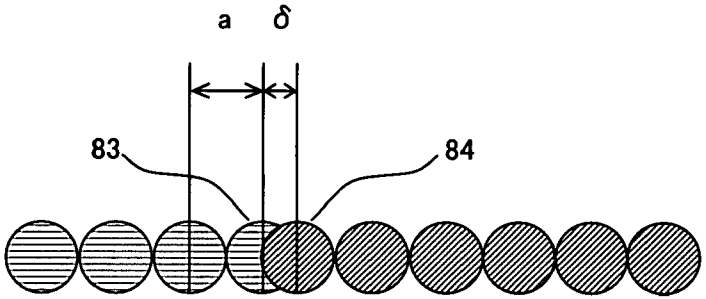
FIGS. 7A and 7B show the concept of an overlapped part in the case where no nozzle array overlap is corrected.
Figure 7A:
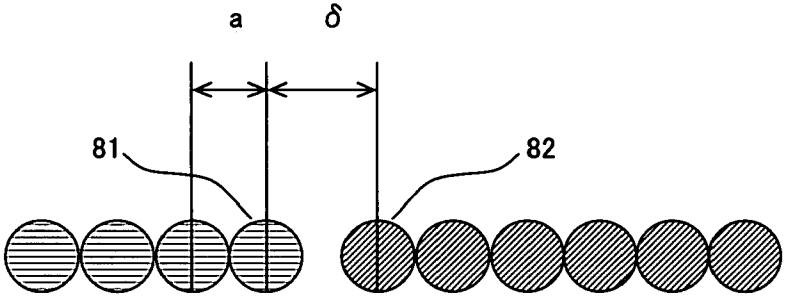

If the recording heads 71 and 72 are disposed in the position relationship shown in FIG. 6A, the output dot formed on the image-formed material 31 is formed in the position relationship shown in FIG. 7A. The main scan direction phase difference δ in this case has the relationship of δ>a, and the distance between the output dot 81 of the ink-jet nozzle 73 and the output dot 82 of the ink-jet nozzle 74 increases.

Thus, in the nozzle array overlapped part, the optical density of the output dot formed on the image-formed material 31 decreases. Therefore, the optical density of the nozzle array overlapped part becomes lower than the optical density of the output dot of the ink-jet nozzle adjacent to the nozzle array overlapped part, and as a result, striped optical density unevenness occurs.

If the recording heads 71 and 72 are disposed in the position relationship shown in FIG. 6B, the output dot formed on the image-formed material 31 is formed in the position relationship shown in FIG. 7B. The main scan direction phase difference δ in this case has the relationship of δ<a, and the distance between the output dot 81 of the ink-jet nozzle 73 and the output dot 82 of the ink-jet nozzle 74 decreases.

Thus, in the nozzle array overlapped part, the optical density of the output dot formed on the image-formed material 31 increases. Therefore, the optical density of the nozzle array overlapped part becomes higher than the optical density of the output dot of the ink-jet nozzle adjacent to the nozzle array overlapped part, and as a result, striped optical density unevenness occurs.

In this preferred embodiment, if one nozzle array and the other nozzle array are overlapped and adjacently disposed, optical density unevenness caused according to the phase difference between the ink-jet nozzle of the one nozzle array in the overlapped part and the ink-jet nozzle of the other nozzle array is corrected by controlling the jet of each ink-jet nozzle and changing the output dot formed on the image-formed material 31 by the overlap correction control unit 47.

The change of an output dot includes at least one of the modification of a target ink-jet nozzle jetting ink and the modification of the diameter of a dot formed by ink jetted by the ink-jet nozzle.

Figure 8B:
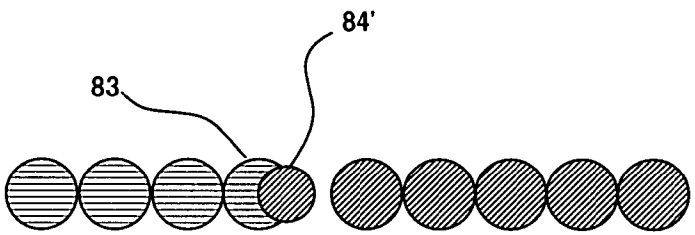
FIGS. 8A and 8B show the concept of an overlapped part in the case where nozzle array overlap is corrected.
Figure 8A:
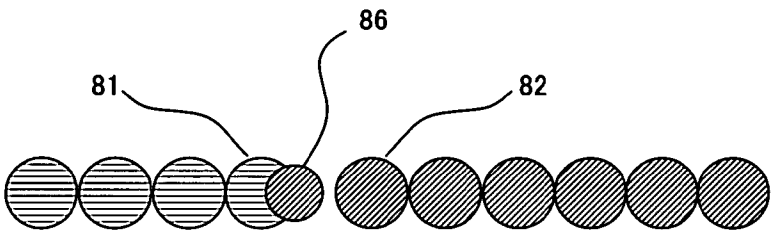

FIG. 8A shows an output dot formed on the image-formed material 31 after the nozzle array overlap correction when the main scan direction phase difference δ has the relationship of δ>a, as shown in FIG. 7A.

The output dot 86 shown in FIG. 8A is formed on the image-formed material 31 by the ink-jet nozzle 77 of the recording head 72 shown in FIG. 6A. The amount of ink jetted when forming the output dot 86 is determined by multiplying the input image signal 41 by a optical density correction co-efficient according to the above-described main scan direction phase difference δ and quantizing this multiplied value into eight gradation values by the overlap correction control unit 47.

In this way, in this preferred embodiment, the optical density unevenness of the nozzle array overlapped part can be corrected by adding the output dot 86 shown in FIG. 8A by the nozzle array overlap correction of the overlap correction control unit 47.

FIG. 8B shows an output dot formed on the image-formed material 31 after the nozzle array overlap correction when the main scan direction phase difference δ has the relationship of δ<a, as shown in FIG. 7B.

The output dot 86 shown in FIG. 8B is formed on the image-formed material 31 by the ink-jet nozzle 76 of the recording head 72 shown in FIG. 6B. The amount of ink jetted when forming the output dot 84 is determined by multiplying the input image signal 41 by a optical density correction co-efficient according to the above-described main scan direction phase difference δ and quantizing this multiplied value into eight gradation values by the overlap correction control unit 47.

In this way, in this preferred embodiment, the optical density unevenness of the nozzle array overlapped part can be corrected by changing (reducing) the dot diameter of the output dot 84' shown in FIG. 8B by the nozzle array overlap correction of the overlap correction control unit 47.

The above-described nozzle array overlap correction of the overlap correction control unit 47 is applied to several lines of image signals of a plurality of line image signals in the input image signal 41 (the above-described 1~n lines of image signals). In the course of this nozzle array overlap correction, a quantizing error caused when quantizing the input image signal into eight gradation values is diffused into one subsequent line of image signal.

Figure 9B:
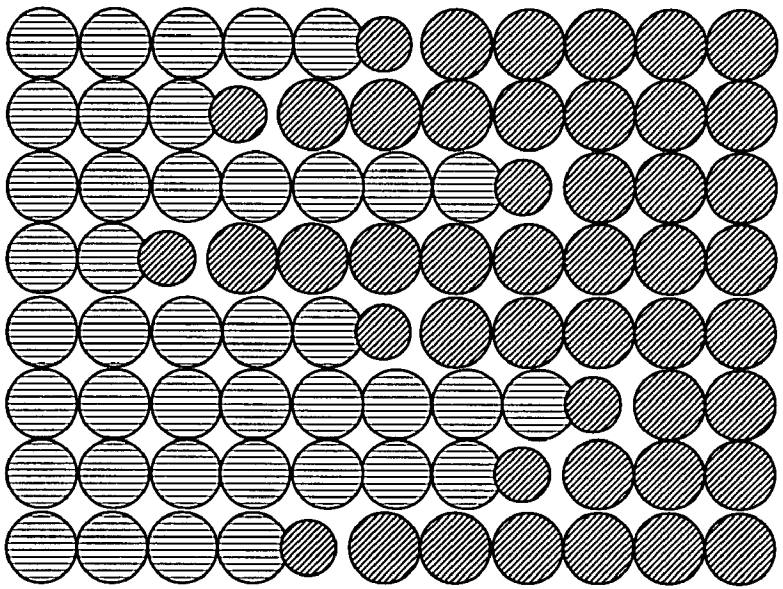
FIGS. 9A and 9B show the concept of a formation dot which becomes the joint point of the nozzle array overlapped parts of recording heads.
Figure 9A:
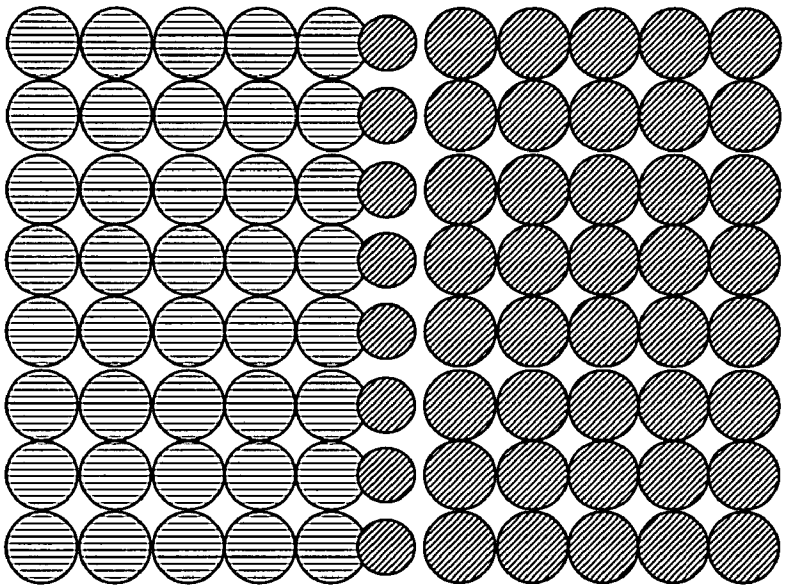

FIG. 9A shows an output dot formed on the image-formed material 31 by a plurality of lines of image signals after the nozzle array overlap correction.

As shown in FIG. 9A, the joint part of the output dots formed on this image-formed material 31 is formed linearly when viewed from the sub scan direction.

As shown in FIG. 9B, the optical density unevenness of the joint part of the output dots formed on this image-formed material 31 can be made unremarkable by moving the joint part, for example, in the main scan direction at random.

This joint part of output dots can be at random when viewed from the sub scan direction, by moving the switch position between an image signal divided into one nozzle array of the overlap part and an image signal divided into the other nozzle array.

In the nozzle array overlap correction of this preferred embodiment, the optical density correction of the nozzle overlapped part is applied only to the one output dot corresponding to the joint part, and no quantizing error caused by this nozzle array overlap correction is diffused into an output dot adjacent to the output dot of the joint part.

In the optical density correction process of this preferred embodiment, the quantizing error caused by the nozzle array overlap correction is prevented from diffusing into outside the nozzle array overlap part by providing the optical density characteristic correction control unit 46 and the overlap correction control unit 47 in the former and later stages, respectively.

Thus, in the optical density correction process of this preferred embodiment, both optical density unevenness due to a nozzle array overlapped part, the change inclination of whose optical density value is large and steep and optical density unevenness due to a non-uniform forming characteristic (recording characteristic) of a nozzle array adjacent to the nozzle overlapped part, the change of whose optical density value is small and gentle can be corrected.

Although as described above, the optical density correction of a nozzle array overlapped part of this preferred embodiment is applied only to one output dot of a ink-jet nozzle corresponding to the above-described joint part, the application of the optical density correction is not limited to this ink-jet nozzle and can also be applied to a plurality of ink-jet nozzles.

In the optical density correction of a nozzle array overlapped part of this preferred embodiment, for example, as shown in FIG. 10, the optical density unevenness can also be corrected by multiplying the input image signal 41 inputted to a plurality of ink-jet nozzles corresponding to the nozzle array overlapped part by a optical density correction co-efficient and controlling it.

Figure 10A:
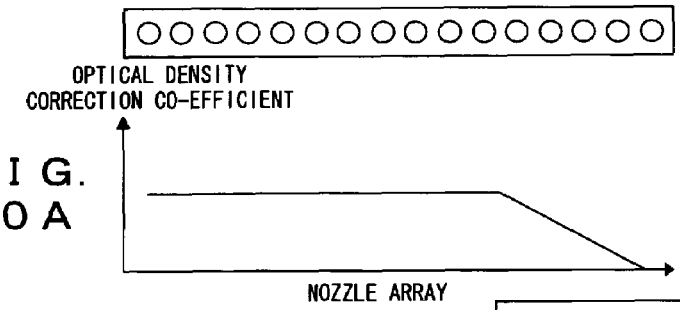
FIGS. 10A, 10B and 10C show the concept in the case where the nozzle array overlapped part of recording heads is corrected across a plurality of ink-jet nozzles.
Figure 10B:
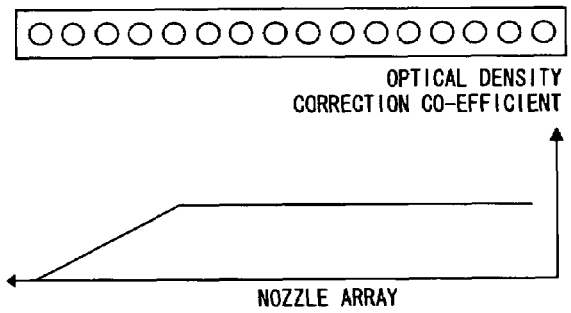

FIG. 10A shows a optical density correction co-efficient multiplied to each ink-jet nozzle of one nozzle array (left side) in an overlapped part when the one nozzle array and the other nozzle array are overlapped and adjacently disposed. FIG. 10B shows a optical density correction co-efficient multiplied to each ink-jet nozzle of the other nozzle array (right side) in an overlapped part when the one nozzle array and the other nozzle array are overlapped and adjacently disposed.

Figure 10C:
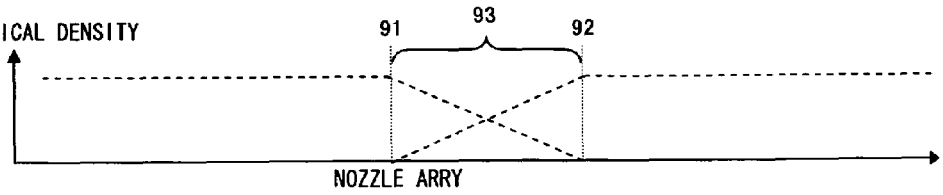

As shown in FIG. 10C, in the optical density correction of a nozzle array overlapped part of this preferred embodiment, the optical density unevenness can be corrected as a result, by forming an image after multiplying the input image signal 41 inputted to each ink-jet nozzle of one nozzle array (left side) in an overlapped part by the optical density correction co-efficient shown in FIG. 10A and multiplying the input image signal 41 inputted to each ink-jet nozzle of one nozzle array (right side) in the overlapped part by the optical density correction co-efficient shown in FIG. 10B.

Figure 1A:
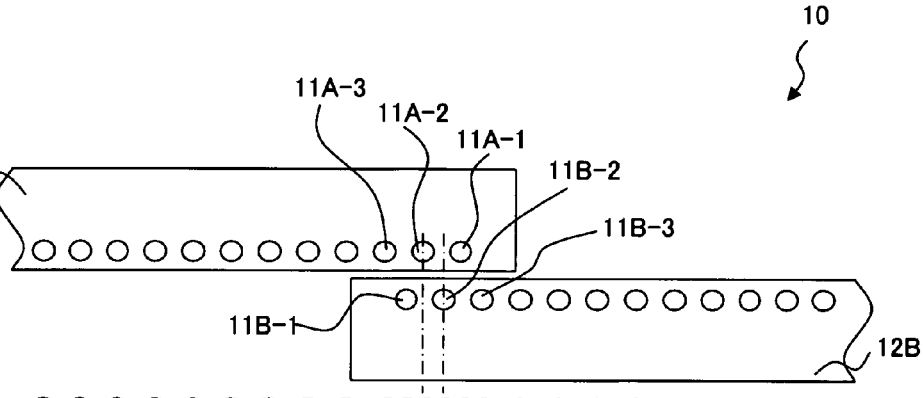
FIGS. 1A, 1B and 1C roughly show the nozzle array overlap correction of patent reference 1.
Figure 1B:
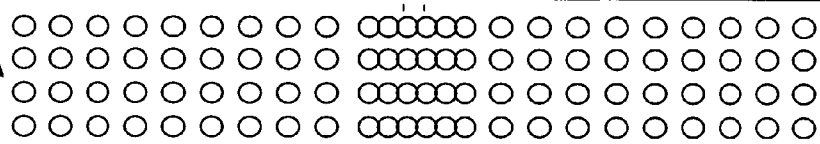
Figure 1C:
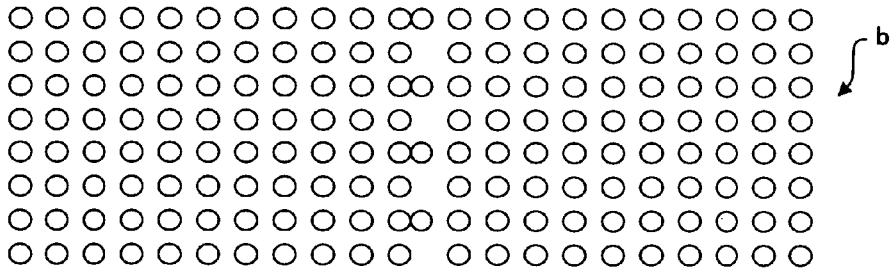
Figure 2A:
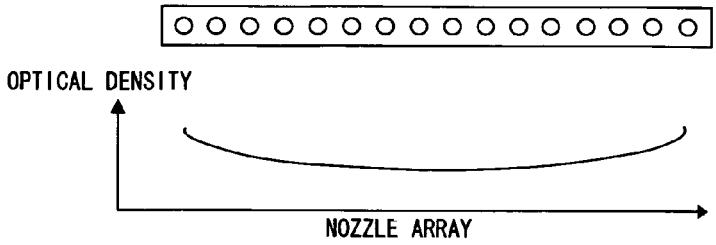
FIG. 2A shows the recording optical density characteristic of a single recording head.
Figure 2B:
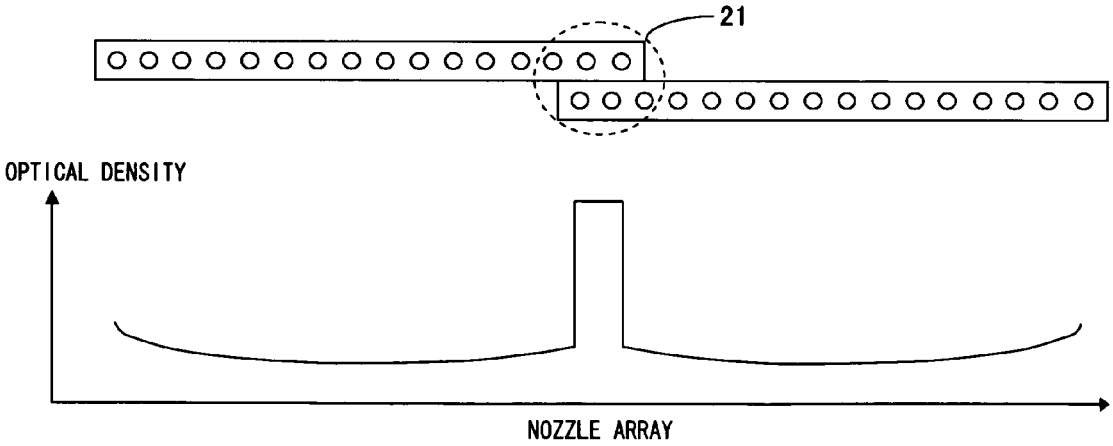
FIG. 2B shows the recording optical density characteristic in the case where two recording heads are overlapped and jointed.

FIG. 1C shows a nozzle array overlap correction area 93 to which nozzle array overlap correction is applied, by dotted lines 91 and 92. In the course of this nozzle array overlap correction, a quantizing error caused when quantizing the optical density into eight gradation values is diffused into the input image signal 41 corresponding to this nozzle array overlap correction area 93.

For example, as shown in FIG. 11, in the optical density correction of a nozzle array overlap part of this preferred embodiment, a plurality of error conversion/distribution co-efficients for diffusing a quantizing error from a processed pixel to a peripheral pixel is provided and used for separate purposes.

FIG. 11 shows a pixel X whose caused quantizing error is processed and an error conversion/distribution co-efficient (FIG. 16) into its peripheral pixels. For example, a quantizing error caused by quantization is diffused into the pixel in which "7" is indicated at the ratio of 7/16.

Figure 11A:
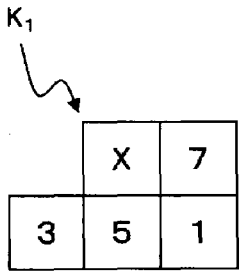
FIGS. 11A, 11B and 11C show examples of an error conversion distribution co-efficient.

The error conversion/distribution co-efficient K1 shown in FIG. 11A is a normal diffusion co-efficient and is applied to a nozzle array overlap correction area 93 other than the area enclosed by dotted lines 91 and 92 shown in FIG. 10C.

Figure 11B:
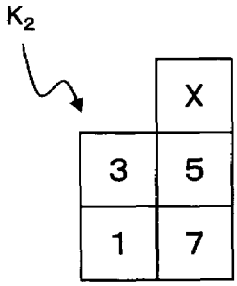
Figure 11C:
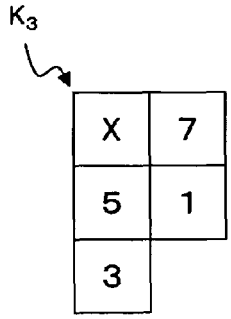

The error conversion/distribution co-efficient K2 shown in FIG. 11B is designed to diffuse no error into the right side of the pixel X and is applied to a pixel on the right boundary of the nozzle array overlap correction area 93 enclosed by the dotted line 92 shown in FIG. 10C. The error conversion/distribution co-efficient K3 shown in FIG. 11C is designed to diffuse no error into the left side of the pixel X and is applied to a pixel on the left boundary of the nozzle array overlap correction area 93 enclosed by the dotted line 91 shown in FIG. 10C.

As described above, in the optical density correction of a nozzle array overlapped part of this preferred embodiment, a quantizing error caused when quantizing the optical density into eight gradation values in its correction course can be prevented from diffusing into an area adjacent to the nozzle array overlap correction area 93 by restricting the diffusion range of a quantizing error.

Therefore, in the optical density correction process of this preferred embodiment, both optical density unevenness due to a nozzle array overlapped part, the change inclination of whose optical density value is large and steep and optical density unevenness due to a non-uniform forming characteristic (recording characteristic) of a nozzle array adjacent to the nozzle overlapped part, the change of whose optical density value is small and gentle can be corrected.

Next, the determination procedure of a optical density correction parameter composed of a optical density correction co-efficient and the like, which is set in advance in the optical density characteristic correction control unit 46 and the overlap correction control unit 47 in the optical density correction process of this preferred embodiment is described.

This optical density correction parameter is determined at the time of plant shipment, re-adjustment after exchanging the recording head of a nozzle array unit, of the image forming apparatus 30.

Figure 12:
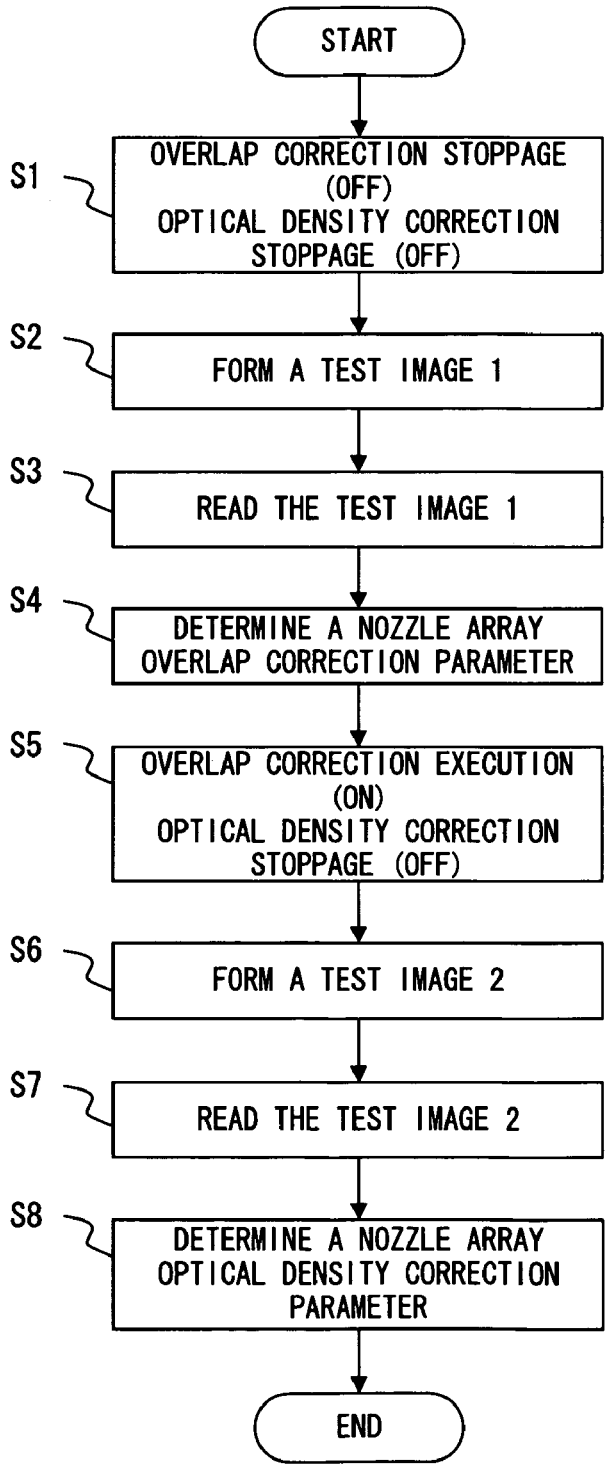
FIG. 12 is a flowchart showing the process at the time of optical density correction parameter setting.

FIG. 12 is a flowchart showing the determination procedure of the optical density correction parameter.

The image forming apparatus 30 reads a test image formed on the image-formed material 31 by the imaging apparatus 42 connected to the image forming apparatus 30 and determines this optical density correction parameter, based on its result.

The optical density correction process of this preferred embodiment is performed by setting this determined optical density correction parameter in the optical density characteristic correction control unit 46 and the overlap correction control unit 47 of the image forming apparatus 30.

It is preferable to set this optical density correction parameter after setting basic image formation parameters, such as the main and sub scan direction positions of the test image formed on the image-formed material 31, color overlap position information for piling several pieces of color ink on the same position of the image-formed material 31 in a prescribed pattern as a test image or the like.

In the optical density correction determining procedure shown in FIG. 12, firstly in step S1, the nozzle array optical density correction of the correction function by the optical density characteristic correction control unit 46 and the nozzle array overlap correction of the correction function by the overlap correction control unit 47 are stopped.

In the optical density correction parameter determining procedure of this preferred embodiment, the stoppage (off)/execution (on) of this correction function can also be switched by an operator operating the operation panel of the image forming apparatus 30 or the like. Alternatively, the image forming apparatus 30 can automatically switch between the stoppage (off)/execution (on) of this correction function when a optical density correction parameter determination mode is started.

Then, in step S2, a test image 1 for determining a nozzle array overlap correction parameter in the image forming apparatus 30 is formed on the image-formed material 31. As described above, it is preferable for the test image 1 formed in step S2 to be suited to detect the phase difference in a jet position between overlapped nozzle arrays of a nozzle array unit disposed in such a way that the respective ends of nozzles arrays of a plurality of recording heads overlap when viewed from the sub scan direction.

Therefore, as the test image, an image in which a reference distance between ink-jet nozzles can be measured or an image in which a phase difference can be estimated from optical density unevenness caused by the phase difference is used.

Since this test image 1 is used as a correction reference, an image is formed after the correction is stopped in step S1.

Figure 13A:
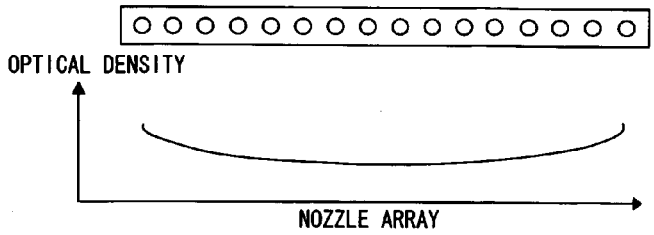
FIGS. 13A, 13B and 13C show the optical density correction parameter determining process used for the nozzle array overlap correction.

FIG. 13A shows an example of a recording head with nozzle arrays having non-uniform forming characteristic (recording characteristic), in which images with different optical density are formed on the image-formed material 31 depending on the ink-jet nozzle position of a nozzle array.

Figure 13B:
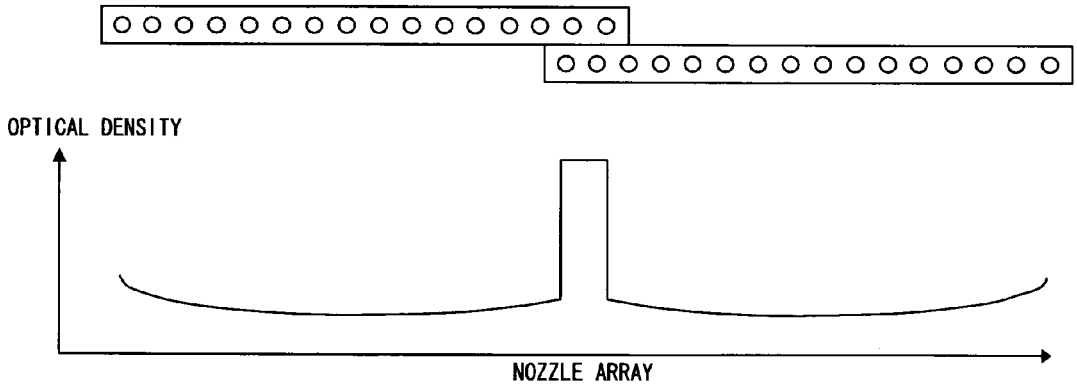
Figure 13C:
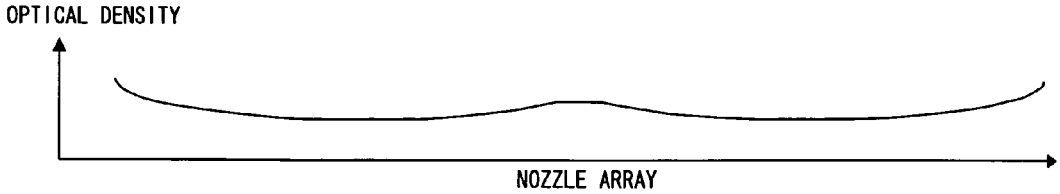

FIG. 13B shows the optical density of an image which the recording heads with non-uniform forming characteristic (recording characteristic) shown in shown 13A form on the image-formed material 31 by nozzle array units disposed with an overlapped part while the optical density correction of this preferred embodiment is stopped.

The optical density value of the nozzle array overlapped part shown in FIG. 13B is large and its change inclination is steep. The test image 1 is used to determine a nozzle array overlap parameter for correcting the optical density of this nozzle array overlapped part.

Then, in step S3, the imaging apparatus 42 reads the test image 1 formed in step S2.

Then, in step S4, the phase difference in a ink-jet nozzle position between overlapped nozzle arrays is detected based on the reading result in step S3 and a nozzle array overlap parameter, such as a optical density correction co-efficient or the like, is determined based on the phase difference. Then, the determined nozzle array overlap correction parameter is stored in the non-volatile memory of the overlap correction control unit 47.

In this determination of the nozzle array overlap correction parameter in step S4, it is preferable to eliminate optical density unevenness due to the non-uniform forming characteristic (recording characteristic) for each nozzle array, in which the change of its optical density value is small and gentle in order to determine parameters for correcting only optical density unevenness due to the phase difference in a ink-jet nozzle position between overlapped nozzle arrays and to improve the accuracy of this nozzle array overlap correction parameter.

Then, in step S5, nozzle array overlap correction by the overlap correction control unit 47 is executed (made on) and nozzle array optical density correction by the optical density characteristic correction control unit 46 is stopped (made off).

Then, in step S6, a test image 2 for determining a nozzle array optical density correction parameter is formed on the image-formed material 31. It is preferable for this test image 2 to be an image in which optical density unevenness due to a non-uniform forming characteristic (recording characteristic) for each nozzle array, such as a half-tone image formed by dots of one to seven grades or the like.

The test image 2 formed in step S6 becomes the image whose optical density unevenness in a nozzle array overlapped part is corrected by the nozzle array overlap correction.

Then, in step S7, the imaging apparatus 42 reads the test image 2 formed in step S6.

Then, in step S8, a nozzle array optical density correction parameter is determined by the reading result in step S7. Then, the determined nozzle array optical density correction parameter is stored in the non-volatile memory of the optical density characteristic correction control unit 46.

This nozzle array optical density correction parameter determined in step S8 can improve its accuracy since it determines the parameter value based on an image whose optical density unevenness in a nozzle array overlapped part is corrected by the nozzle array overlap correction.

Next, the mode setting operation in the case where an operator forms an image in the optical density correction process of the image forming apparatus 30 in this preferred embodiment and the optical density correcting operation based on this mode setting process are described.

In the image forming apparatus 30 of this preferred embodiment, an operator can set an image forming mode suitable for a difference in the data of an image formed on the image-formed material 31 (the input image signal 41) or a difference in the material quality or the like of the image-formed material 31 in the mode setting unit 38.

The image forming apparatus 30 of this preferred embodiment determines the respective optical density correction methods of the optical density characteristic control unit 46 and the overlap correction control unit 47, based on the selected image forming mode to form an image.

If the operator does not set (select) the image forming mode, priority is given to a optical density correction process set as a default, which is described later, to correct a formed image.

Next, an operator-settable image forming mode is described.

The image forming apparatus 30 of this preferred embodiment has two types of modes; for example, a linear priority mode in which image data is character information, graphics or the like and a hue priority (optical density priority) mode in which image data is a picture or the like.

Since in the linear priority mode, priority is given to character information or the linearity of each line in graphics, no optical density correction process is performed.

Since in the hue priority (optical density priority) mode, priority is given to the reproducibility of hue for each ink color of, for example, black (K), cyan (C), magenta (M) and yellow (Y) and the hue of an overlapped color in the case where dots of each ink color is formed in the same position of the image-formed material 31, a optical density correction process is performed.

The optical density correction processes in the case of forming an image are the same in improving the uniformity of image optical density. However, the optical density of the entire formed image has a tendency to decrease.

This is because a general optical density correction process reduces the output dots in a high-optical density part in such a way as to match image optical density in the high-optical density part of a formed image on the image-formed material 31 to that of the low-optical density part of the formed image on the image-formed material 31, that is, image optical density in a part in which the diameter of an output dot jetted from a recording head is small and to make the image optical density uniform.

The reduced degree of optical density in this entire image varies depending on the difference in the material quality of the image-formed material 31. In the image formation on a piece of ink-jet dedicated coated paper, since image optical density is kept high by the respective characteristics of this piece of ink-jet dedicated coated paper and ink, the image optical density is little influenced by the image optical density reduction in the optical density correction process. However, in the image formation on a piece of corrugated paper and a piece of cardboard, since the surface of a piece of corrugated paper and a piece of cardboard which is not especially coated for ink jet is applied and the soaked amount of ink increases, the image optical density is greatly influenced by the image optical density reduction in the optical density correction process.

However, since image data on a piece of corrugated paper and a piece of cardboard is often fairly large character data, little optical density unevenness is no problem.

In image formation on a piece of regular paper which is not especially coated for ink jet, the regular paper has an intermediate characteristic between a piece of ink-jet dedicated coated paper and a piece of corrugated paper/cardboard.

Therefore, in the image forming apparatus 30 of this preferred embodiment, an operator can set an image forming mode suitable for a difference in the data of an image formed on the image-formed material 31 (the input image signal 41) or a difference in the material quality or the like of the image-formed material 31 in the mode setting unit 38.

Next, the optical density distribution (optical density unevenness) status after the image forming apparatus 30 of this preferred embodiment performs the respective optical density correction processes of the optical density characteristic correction control unit 46 and the overlap correction control unit 47, based on the selected hue priority (optical density priority) mode is described with reference to FIG. 14.

Figure 14A:
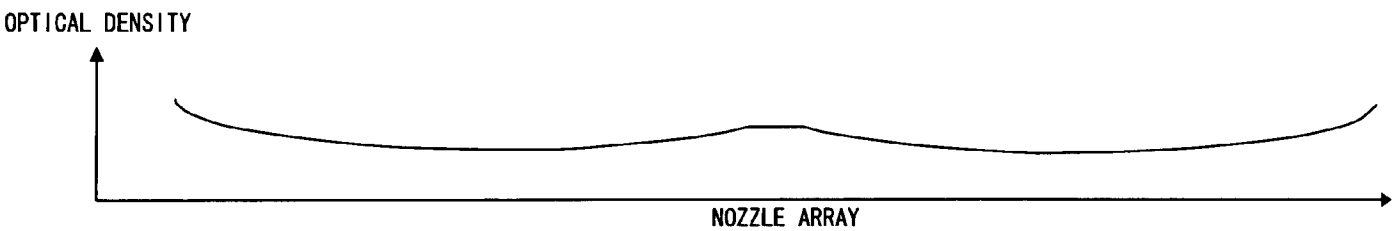
FIGS. 14A, 14B and 14C show how to correct optical density according to an image formation mode.

FIG. 14A shows the optical density distribution (optical density unevenness) in the case where an image is formed on the image-formed material 31 after applying only nozzle array overlap correction by the overlap correction control unit 47 to nozzle array units disposed in such a way that the respective ends of the nozzle arrays of a plurality of recording heads overlap when viewed from the sub scan direction.

Figure 14B:
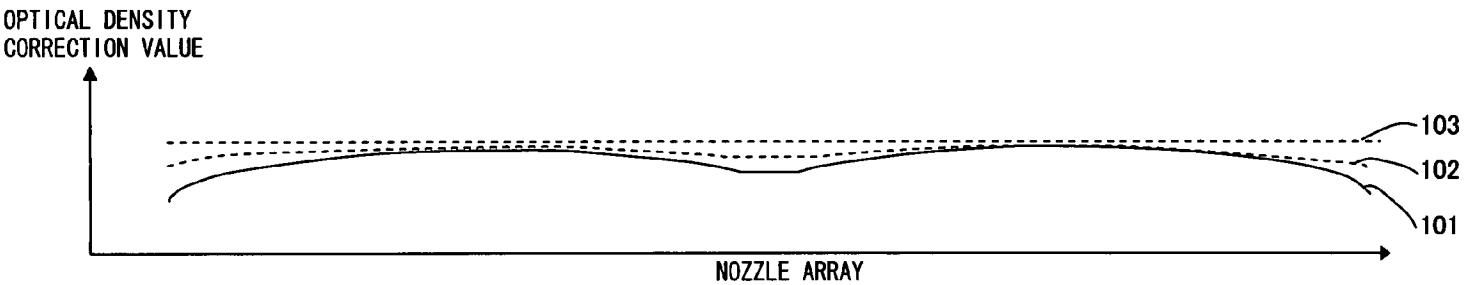

FIG. 14B shows an example of a optical density correction value (optical density correction parameter) added by the nozzle array optical density correction by the optical density characteristic correction control unit 46.

Figure 14C:
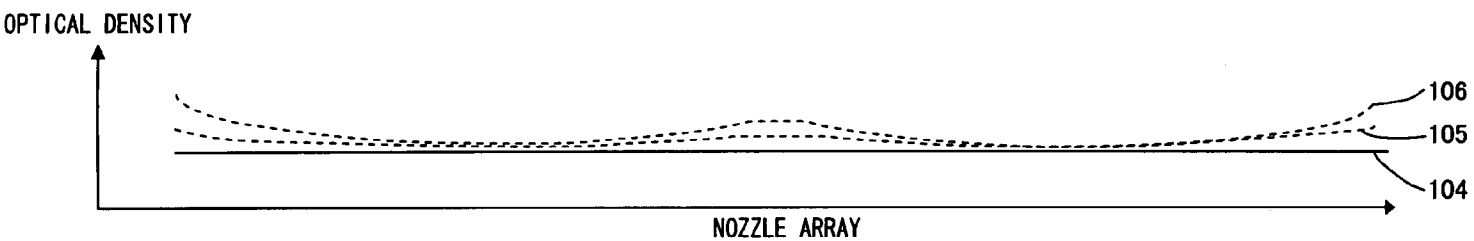

FIG. 14C shows the optical density distribution (optical density unevenness) in the case where an image is formed after the nozzle array optical density correction is applied using the optical density correction value shown in FIG. 14B.

Of three types of optical density correction values shown in FIG. 14B, one indicated by a solid line 101 is the inverse function of the optical density distribution (optical density unevenness) shown in FIG. 14A, and by correcting the input image signal 41 according to this inverse function, the optical density distribution (optical density unevenness) indicated by a solid line 104 in FIG. 14C can be corrected.

Since there occurs almost no optical density unevenness in the optical density correction process indicated by this solid line 104, it is suited to form a picture or the like on a piece of ink-jet dedicated coated paper.

Of the three types of optical density correction values shown in FIG. 14B, one indicated by a dotted line 103 is a optical density correction value in the case where no nozzle array optical density correction is performed, and as shown by a dotted line 106 in FIG. 14C, the input image signal 41 is formed without applying any process to it. The optical density correction process indicated by this dotted line 106 is greatly influenced by the image optical density reduction in the optical density correction process. Therefore, it is suited to form an image on a piece of corrugated paper, a piece of cardboard and the like.

Of the three types of optical density correction values shown in FIG. 14B, one indicated by the dotted line 102 is the intermediate optical density correction value between the optical density correction value indicated by the solid line 101 and the optical density correction value indicated by the dotted line 103, and an almost sufficient optical density correction effect can be obtained by little image optical density reduction in the optical density correction process. Therefore, it is suited to form an image on a piece of regular paper which is not especially coated for ink jet is applied.

As shown by the dotted line in FIG. 14B, this intermediate optical density correction value can be obtained by the inverse function of the optical density distribution obtained by reading an image formed on the image-formed material 31 by the imaging apparatus 42 by a co-efficient with a specific size.

The image forming apparatus 30 of this preferred embodiment stores a plurality of optical density correction values, such as three types of optical density correction values indicated by the solid line 101 and dotted lines 102 and 103 in advance.

An operator can select a hue priority (optical density priority) mode corresponding to this selected contents and form an image to which proper nozzle array optical density correction is applied, by selecting and setting conditions, such as the type of image data (the input image signal 41), the type of the image-formed material 31 and the like, in the mode setting unit 38 of the image forming apparatus 30, for selection/setting excluding the linear priority mode.

For the hue priority (optical density priority) mode selected by the operator, image quality, specifically, a correction value for the optical density correction process can also be selected when performing the optical density correction process. Alternatively, it can be selected which the optical density of an image to be corrected is, high or low.

The optical density correction by the image forming apparatus 30 of this preferred embodiment can also be realized not only in the case of the full line type image forming apparatus 30 but also the serial type image forming apparatus 30.

Figure 15:
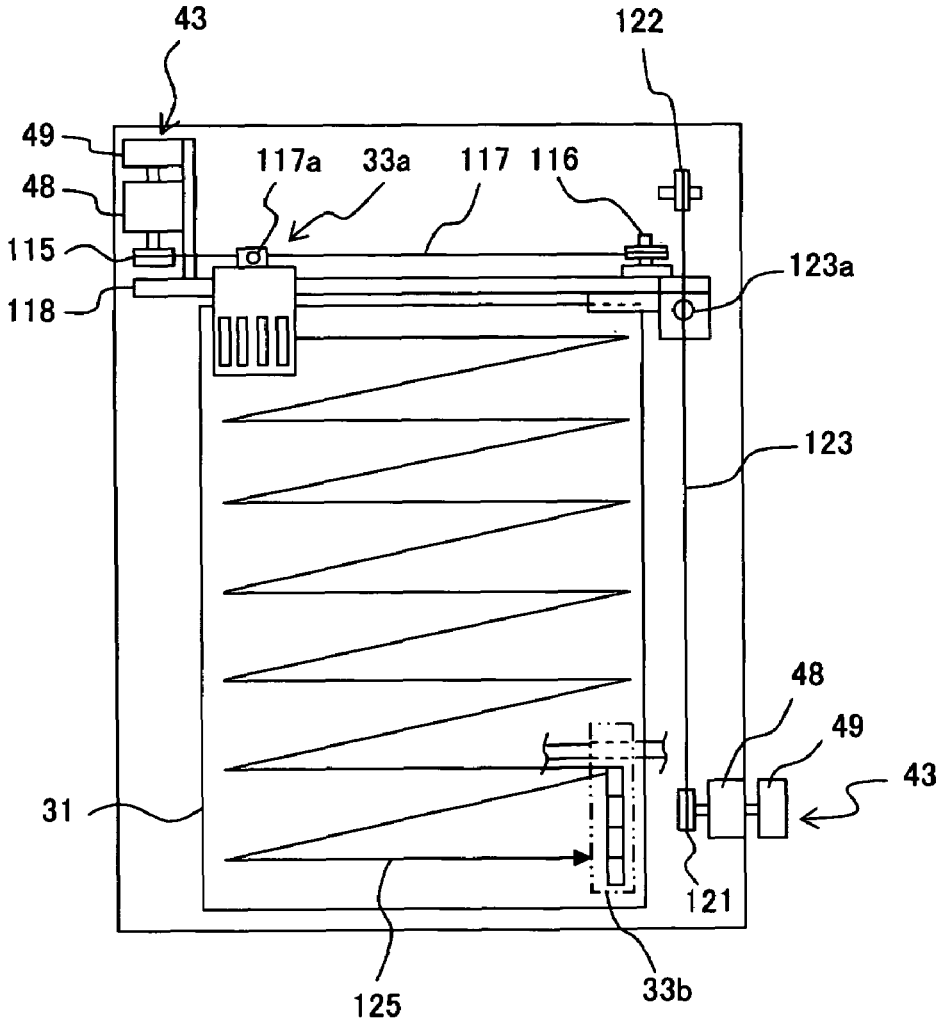
FIG. 15 shows an example of the configuration in the case where the image forming apparatus of the preferred embodiment is of a serial type.

FIG. 15 shows the simplified configuration of the serial type image forming apparatus and shows the simplified configuration of the serial type image forming apparatus in which the image-formed material 31 is not moved in the sub scan direction.

FIG. 15 also roughly shows a carriage 33B by a two-dot chain line, in which the disposition form of color nozzle array units are different from that of a carriage 33A, in addition to the carriage 33A in which color nozzle array units are disposed in the main scan direction in parallel and at prescribed intervals in the moving object 33.

In the serial type image forming apparatus 30 shown in FIG. 15, the carriages 33A or 33B are supported by a support member 118 in such a way to move back and forth in the upper section of the fixed and mounted image-formed material 31. At one end of this support member 118, one the moving mechanism 43 is constituted by the motor of one the moving mechanism driver unit 48 for rotating a pulley 115 and a rotary encoder of one the moving position information generating unit 49. At the other end of the support member 118, a pulley 116 is disposed opposed to the pulley 115 in the main scan direction. The pulleys 115 and 116 are installed in such a way as to move back and forth in the main scan direction, and are connected to the carriage 33A or 33B by a connecting unit 117*a*.

Thus, the carriage 33A or 33B is moved back and forth in the main scan direction by the rotation of the motor of one the moving mechanism driver unit 48, and also the moving position of the carriage 33A or 33B is notified to the control unit 37 of the image forming apparatus 30.

In the vicinity of the other end of the support member 118, a pulley 122 is disposed. In the position opposed to this pulley 122 in the sub scan direction, other the moving mechanism 43 is constituted by the motor of other the moving mechanism driver unit 48 for rotating a pulley 121 and the rotary encoder of other the moving position information generating unit 49 provided for the rotation shaft of this motor. In the pulleys 121 and 122, an endless belt 123 is installed in such a way as to move back and forth in the sub scan direction and is connected to the other end of the support member 118 by a connecting unit 123*a*.

Thus, the support member 118 is moved back and forth in the sub scan direction by the rotation of the motor of other the moving mechanism driver unit 48, and also the rotary encoder of other the moving position information generating unit 49 notifies the control unit 37 of the image forming apparatus 30 of the moving position of the support member 118.

If the image forming apparatus of the preferred embodiment is of a serial type, by adopting such a configuration, the serial type image forming apparatus 30 of the preferred embodiment can form an image by scanning the carriage 33A or 33B on the image-formed material 31 along a scan trace 125 while informing the control unit 37 of a moving position in the case where the carriage 33A or 33B is moved in the main and sub scan directions in the moving object 33.

Figure 16:
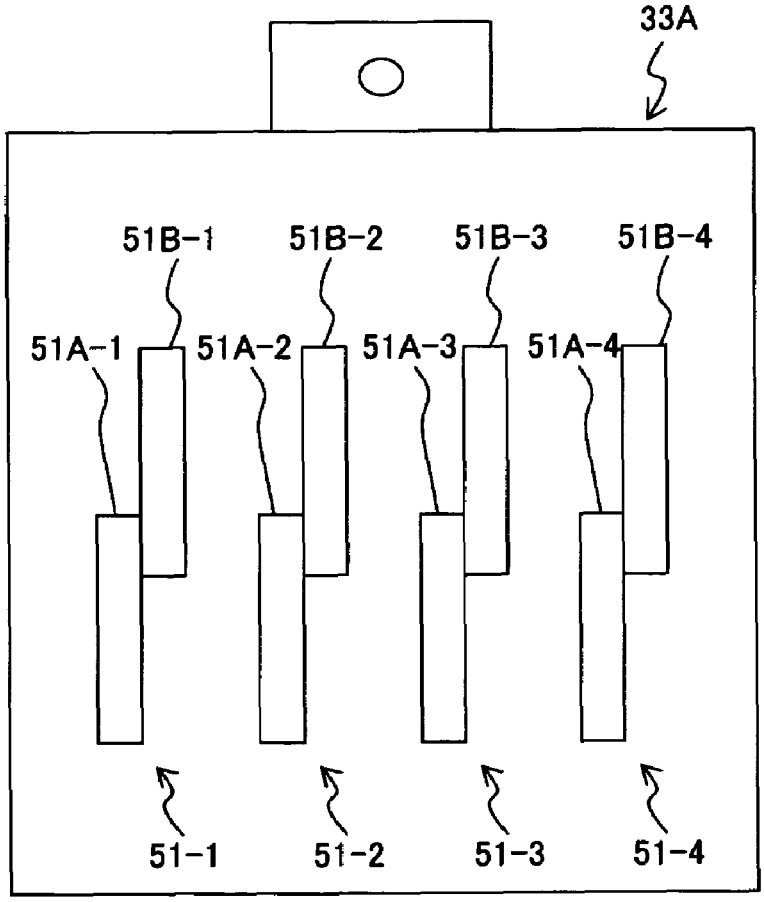
FIG. 16 shows an example of the configuration of a carriage in the case where the image forming apparatus of the preferred embodiment is of a serial type, and an example of the array of the nozzle array units in the carriage.

FIG. 16 shows an example of the configuration of a carriage in the case where the image forming apparatus of the preferred embodiment is of a serial type, and an example of the array of the nozzle array units in the carriage.

In the carriage 33A shown in FIG. 16, a (K) nozzle array unit 51-1, a (C) nozzle array unit 51-2, a (M) nozzle array unit 51-3 and a (Y) nozzle array unit 51-4 are disposed as color-corresponding nozzle array units in parallel in the main scan direction at prescribed intervals. The color the nozzle array units 51-1~51-4 are composed of a pair of short recording heads 51A-1 and 51B-1~51A-4 and 51B-4, respectively.

Figure 17:
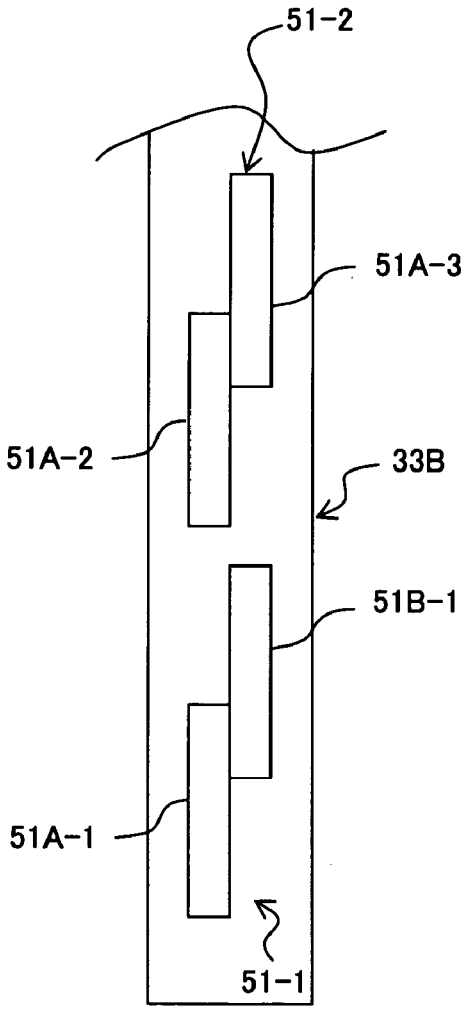
FIG. 17 shows an example of the configuration of each carriage in the case where the image forming apparatus of the preferred embodiment is of a serial type, and an example of the array of the nozzle array units in the carriage.

FIG. 17 shows an example of the configuration of each carriage in the case where the image forming apparatus of the preferred embodiment is of a serial type, and an example of the array of the nozzle array units in the carriage.

In the carriage 33B shown in FIG. 16, (K), (C), (M) and (Y) nozzle array units 51-1, 51-2, 51-3 and 51-4 (51-3 and 51-4 are not shown in FIG. 17), are disposed as color-corresponding nozzle array units in the sub scan direction at prescribed intervals or at no intervals in parallel with the sub scan direction. The color the nozzle array units 51-1~51-4 are composed of a pair of short recording heads 51A-1 and 51B-1~51A-4 and 51B-4, respectively.

As described so far, according to the image forming apparatus of this preferred embodiment, in the image forming apparatus comprising one long recording head by disposing a plurality of short recording heads, striped optical density unevenness due to the joint part of adjacent short recording heads, white wiping and the like can be made not remarkable and optical density unevenness due to the non-uniform recording optical density characteristic of the short recording heads can also be corrected when forming an image, without strictly adjusting the positions of the short recording heads.

According to the image forming apparatus of this preferred embodiment, since an quantizing error caused by nozzle array overlap correction is not diffused into outside the nozzle array overlapped part, both optical density unevenness due to the nozzle array overlapped part, whose optical density value is large and, the change inclination of whose optical density value is steep and optical density unevenness due to the non-uniform forming characteristic (recording characteristic) of a nozzle array adjacent to a nozzle array overlapped part, the change of whose optical density value is small and gentle can be corrected.

Although the nozzle array unit of this preferred embodiment comprises two nozzles arrays composed of a plurality of nozzles, it can also comprise three or more such array units.

The nozzle array unit of this preferred embodiment can also similarly comprise short recording heads obtained by jointing a plurality of recording heads with one or more nozzle arrays and a long recording head can be obtained by disposing a plurality of these short recording heads in one direction.

What is claimed is:

1. An image forming apparatus provided with a recording head obtained by overlapping and disposing a plurality of short recording heads with a nozzle array of ink-jet nozzles arrayed in one direction, wherein the ink-jet nozzles of adjacent ones of the short recording heads overlap each other, said image forming apparatus comprising:

an overlap correction control unit for controlling drive of the ink-jet nozzles according to a phase difference in an ink-jet nozzle position between the overlapped short recording heads to correct an optical density of an image formed on an overlapped part of the recording heads;

an optical density characteristic correction control unit for controlling drive of the ink-jet nozzles according to a recording optical density characteristic of the nozzle array independently of the overlap correction control unit; and a control unit for controlling the overlap correction control unit to operate after the optical density characteristic correction control unit performs correction according to the recording optical density characteristic of the nozzle array.

2. The image forming apparatus according to claim 1, wherein the overlap correction control unit and the optical density characteristic correction control unit are independent pieces of hardware.

3. The image forming apparatus according to claim 1, wherein the overlap correction control unit calculates an optical density correction signal of the overlapped part, based on a first correction parameter set according to the phase difference in the ink-jet nozzle position between the overlapped short recording heads and an image signal value corresponding to at least one ink-jet nozzle in the overlapped part, and quantizes the optical density correction signal of the overlapped part into a value corresponding to each of the short recording heads, and wherein the optical density characteristic correction control unit calculates each optical density correction signal based on a second correction parameter set according to the recording optical density characteristic of the ink-jet nozzles in the short recording heads and each optical density value of image signal value corresponding to each ink-jet nozzle of the short recording heads, and quantizes each of the optical density correction signals into a value corresponding to the respective short recording heads, and wherein the overlap correction control unit does not add a quantizing error due to the quantization to each of the optical density correction signals calculated by the optical density characteristic correction control unit.

4. The image forming apparatus according to claim 3, wherein after the first correction parameter value is determined and is set in the overlap correction control unit, the second correction parameter value is determined and is set in the optical density characteristic correction control unit.

5. The image forming apparatus according to claim 3, wherein a first test image used when determining and setting the first correction parameter value is formed after respective correction of the overlap correction control unit and the optical density characteristic correction control unit is stopped, and a second test image used when determining and setting the second parameter value is formed by the overlap correction control unit after correction of the optical density characteristic correction control unit is stopped.

6. The image forming apparatus according to claim 1, further comprising a mode setting unit from which an operator inputs an instruction of execution/stoppage of respective correction of the overlap correction control unit and the optical density characteristic correction control unit, wherein a correction process based on an image signal value by the overlap correction control unit and the optical density characteristic correction control unit is executed/stopped based on inputs from the mode setting unit.

7. The image forming apparatus according to claim 6, wherein the optical density characteristic correction control unit corrects the image signal value, based on an image formation mode that the operator inputs and sets from the mode setting unit.

8. The image forming apparatus according to claim 7, wherein the image formation mode corresponds to a type of an imageformed material on which an image is formed.

9. The image forming apparatus according to claim 7, wherein the image formation mode includes a linear priority mode emphasizing linearity of a formed image and a hue priority mode emphasizing optical density unevenness of a formed image.

10. The image forming apparatus according to claim 1, wherein when forming an image, the overlap correction control unit performs correction after the optical density characteristic correction control unit corrects an image signal value.

11. An image forming method for an image forming apparatus provided with a recording head obtained by overlapping and disposing a plurality of short recording heads with a nozzle array of ink-jet nozzles arrayed in one direction, wherein the ink-jet nozzles of adjacent ones of the short recording heads overlap each other, said image forming method comprising:

controlling drive of the ink-jet nozzles according to a phase difference in an ink-jet nozzle position between the overlapped short recording heads to correct an optical density of an image formed on an overlapped part of the recording heads; and controlling drive of the ink-jet nozzles according to a recording optical density characteristic of the nozzle array independently of the controlling to correct the optical density of the image formed on the overlapped part of the recording heads, wherein the controlling to correct the optical density of the image formed on the overlapped part of the recording heads is performed after correction is performed according to the recording optical density characteristic of the nozzle array.

* * * * *